US006401944B1

(12) United States Patent
Kircher et al.

(10) Patent No.: US 6,401,944 B1
(45) Date of Patent: Jun. 11, 2002

(54) STORAGE RACK SHELVING

(75) Inventors: Timothy G. Kircher, Norfolk; John T. Henning; David J. Cross, both of Virginia Beach; Bert Y. Culpepper, Jr., Chesapeake, all of VA (US)

(73) Assignee: Design Assistance Corporation Systems, Inc., Portsmith, VA (US)

( * ) Notice: Subject to any disclaimer, the term of this patent is extended or adjusted under 35 U.S.C. 154(b) by 0 days.

(21) Appl. No.: 09/613,699

(22) Filed: Jul. 11, 2000

(51) Int. Cl.[7] ..... A47F 5/00

(52) U.S. Cl. ..... 211/134; 211/153; 211/135; 108/157.13; D6/511

(58) Field of Search ..... 211/153, 135, 211/186, 134; 108/157.13; D6/511

(56) References Cited

U.S. PATENT DOCUMENTS

| | | | | |
|---|---|---|---|---|
| 1,073,151 | A | * | 9/1913 | Matthew |
| 1,587,693 | A | * | 6/1926 | Beland et al. |
| 1,979,902 | A | | 11/1934 | Potter et al. |
| 2,381,608 | A | * | 8/1945 | Leyerle |
| 2,606,806 | A | | 8/1952 | Giffard |
| 2,613,818 | A | | 10/1952 | Richard |
| 3,927,769 | A | | 12/1975 | Maslow, et al. |
| 3,986,462 | A | | 10/1976 | Heft |
| 4,292,510 | A | | 9/1981 | Hild |
| 4,478,337 | A | | 10/1984 | Flum |
| D319,362 | S | | 8/1991 | Kellems et al. |
| D334,497 | S | * | 4/1993 | Putty ..... D6/511 |
| 5,199,582 | A | | 4/1993 | Halstrick |
| 5,479,752 | A | | 1/1996 | Menegoli |
| D385,444 | S | | 10/1997 | Welch et al. |
| D412,079 | S | * | 7/1999 | Wegman ..... D6/511 |
| 6,050,428 | A | * | 4/2000 | Hollander ..... 211/135 X |
| 6,079,339 | A | * | 6/2000 | Houk et al. ..... 108/157.13 |

* cited by examiner

*Primary Examiner*—Robert W. Gibson, Jr.
(74) *Attorney, Agent, or Firm*—Hunton & Williams; Christopher C. Campbell

(57) ABSTRACT

A corrugated deck for use as decking or shelving in storage racks is provided. The deck has a plurality of apertures punched or formed into the horizontal surface areas according to a predetermined pattern. Each aperture is punched or formed such that a downwardly sloping, vertical flange is created from the surrounding material. The flange directs the flow of liquid into the aperture from the adjacent horizontal surface areas and reinforces the structural integrity of the deck. A storage rack made with decks of this invention meets fire code requirements regarding the percentage of open area in the shelving and at the same time handles high load-bearing applications.

27 Claims, 5 Drawing Sheets

STORAGE RACK SHELVING

BACKGROUND OF THE INVENTION

1. Field of the Invention

This invention relates to decking or shelving used primarily in industrial and commercial racks for storing goods and articles.

2. Description of the Related Art

Decking or shelving used in industrial and commercial storage racks has to be designed and constructed to bear heavy loads without twisting or buckling. For example, shelving used in bulk storage applications must be able to support the weight of densely packed rows of boxes filled with goods. In such applications, a solid steel sheet deck would be an ideal choice for shelving because it has a high load-bearing capacity.

The design and construction of decking or shelving must comply, however, with the requirements of any fire codes applicable to the particular storage environment. Fire codes generally require that the surface area of each deck or shelf have a certain amount of open area, e.g., a number of holes distributed along the surface of the deck or shelf. Obviously, a solid steel sheet deck would not meet this "open area" requirement and therefore could not be used as storage rack shelving.

The "open area" requirement serves two primary objectives from the standpoint of fire safety and prevention. First, the open area of each deck or shelf allows a fire that has broken out to move vertically up the storage rack instead of spreading horizontally to other storage racks, as the fire would do if it had broken out beneath a solid steel sheet deck. It also allows heat generated by the fire to dissipate instead of building up within a semi-enclosed space, as would be the case in a storage space between two solid steel sheet decks. In short, the open area creates a flue space within a storage rack, thereby causing the fire to travel upward and to release heat in the process. This maximizes the effectiveness of the sprinkler system in containing the fire because it allows the fire to reach the sprinkler heads as quickly as possible without building up too much heat and intensity.

Second, the open area of each deck or shelf allows water from an overhead sprinkler system to flow downward in the event of a fire. As long as water runs freely through the individual decks or shelves, an overhead sprinkler system can adequately contain a fire breaking out at any shelving level and prevent it from spreading to other storage racks.

The amount of open area generally required by fire codes is fifty percent (50%) of the surface area. Lower percentages may be allowed, however, depending on the particular storage environment. As pointed out above, a solid steel sheet deck does not have any open area and therefore would not meet this "fifty-percent" rule. Consequently, it could not be used in bulk storage applications even though it has a high load-bearing capacity.

The fifty-percent rule necessarily calls for a unique solution to the problem of providing structural strength to decking or shelving. Solutions currently available in the industry are simply inadequate.

For example, a wire mesh deck, commonly used in industrial and commercial settings, meets the fifty-percent rule but it deforms relatively easily under heavy loads because it has no uniform loading support. When it deforms, the deck no longer has a flat surface on which to rest boxes. It is difficult enough, even with a flat surface, to load boxes onto a wire mesh deck and to move them from side to side once they are on the deck. The loss of a flat surface further aggravates this problem.

Moreover, a wire mesh deck tends to rip up bulk items, thereby damaging stored goods. Cardboard boxes, carpets, and upholstered goods are susceptible to damage from punctures and snags as they are loaded onto or off a wire mesh deck. A wire mesh deck also creates a safety risk because the wire ends along the so-called "waterfall" edge that hugs the support beam can bend up and cut a worker's stray finger or other body part.

Wire mesh decks require long lead times for production. They cannot be packed densely in shipping, and therefore the costs of shipping are higher than they otherwise could be.

A slatted wooden deck, also commonly used, has disadvantages of its own. Wood burns and smokes readily. It also warps and moves due to moisture and has to be replaced more often than steel. Obviously, wooden decks are not as strong as steel decks, and the individual slats may break, thereby causing a failure in the structural integrity of the deck and a safety hazard for workers.

Another bulk storage solution is a rollformed "front to back bar." This solution consists of a rollformed C-channel with welded end plates that attach to a step beam. This solution is very expensive from a manufacturing standpoint because it uses a lot of heavy gauge steel. Moreover, one still has to use wooden pallets because the solution itself does not provide a flat storage surface.

Recognizing the disadvantages inherent in wire mesh decks and slatted wooden decks, and the need for decking or shelving that meets fire code requirements without sacrificing load-bearing capacity, others besides the present inventors have experimented with alternative designs and constructions. Consider the following examples.

U.S. Pat. No. 5,199,582 to Halstrick discloses storage rack shelving in which there are corrugated decks with channels below the top surface for guiding and confining sprinkler fluid. Evenly spaced along the channels are openings through which sprinkler fluid flows down to the next shelving level. The decks, however, each have an open area of less than one-half of 1% of the total deck area. This obviously would not meet the fifty-percent rule.

Indeed, Halstrick's invention expressly teaches away from the use of open decking. The disclosure of U.S. Pat. No. 5,199,582 considers open decking to be undesirable because it allows hot air to flow upward and cause a chimney effect. The disclosure points out that Halstrick's invention does not permit smoke and gas to flow upwardly.

Contrary to this disclosure and as explained above, open decking actually works together with an overhead sprinkler system to contain a fire. Here is the chain of events that occur when a fire breaks out in a storage environment. The fire's natural tendency is to rise, seeking out additional oxygen. Smoke and hot air also rise. They thus find their way to the closest sprinkler head, which activates and releases a spray of water. The water falls downward, thereby containing the fire and protecting areas adjacent to where the fire started. The open decking also allows excess heat to dissipate more rapidly. This is important because a hotter fire will be more difficult for the sprinkler system to contain, as the water droplets vaporize before they make contact with the flames.

U.S. Pat. No. 3,986,462 to Heft discloses shelving units with circular holes uniformly spaced throughout the surface area to permit the passage of water. Each shelving unit derives its structural strength through the presence of side members depending from the longitudinal edges of the top portion. Each shelf in turn is made up of several shelving units placed side by side on the beams of the rack. One apparent disadvantage with this design is the fact that the shelving units must be precisely sized so that they interlock snugly with the rack beams.

Another disadvantage of Heft's invention is that the units would be prohibitively expensive to manufacture because of the high cost of materials. The units would also be costly to ship and install. Additionally, the circular holes in the shelving units weaken the structure such that the design cannot bear heavy loads. The holes also turn the shelving units into cheese graters that can damage stored goods and injure people.

U.S. Pat. No. 3,927,769 to Maslow et al. discloses a shelf made of a rectangular sheet of material having raised ribs to support items placed thereon and apertures to permit the flow of air or water. The ribs reinforce the shelf structure. Based on the drawings accompanying this patent, however, it does not appear that this design would meet the fifty-percent rule generally required by fire codes today.

Despite alternative designs and constructions that have been proposed over the years, as exemplified by the above patents, wire mesh decks and slotted wooden decks are still widely used in industrial and commercial storage racks. There have been few attempts to address the needs of industry for decking and shelving that meets the fifty-percent rule and yet provides the load-bearing capacity required in bulk storage applications. Such decking or shelving should also be nonflammable and suitable for mass production and shipping at minimal cost.

The invention described below fulfills all of the above objectives. It offers a simple and elegant solution to industry requirements of shelving having up to fifty-percent open area and a structure designed to withstand maximum stress with minimum amount of deflection. This invention provides a smooth flat surface for storage of bulk items. Moreover, in the preferred embodiments, this solution can be readily implemented with minimal retooling of existing machines for fabricating metals and manufactured and shipped at competitive prices.

BRIEF SUMMARY OF THE INVENTION

Decking or shelving made according to the present invention consists of corrugated decks having a plurality of apertures punched or formed into the horizontal surface areas according to a predetermined pattern that specifies the shape, size and frequency of the apertures. The apertures are punched or formed so that a downwardly sloping, vertical flange surrounding each aperture is created. Each flange directs the flow of liquid from the adjacent horizontal surface area of the corrugated deck into the aperture. Each flange also reinforces the structural integrity of the deck, making it suitable for high load-bearing applications. In the preferred embodiments, the corrugated decks are made from galvanized sheet steel, but other materials such as plastics and fiberglass can also be used.

BRIEF DESCRIPTION OF THE DRAWINGS

This invention is described in the following drawing figures.

DETAILED DESCRIPTION OF THE INVENTION

Figure 1:
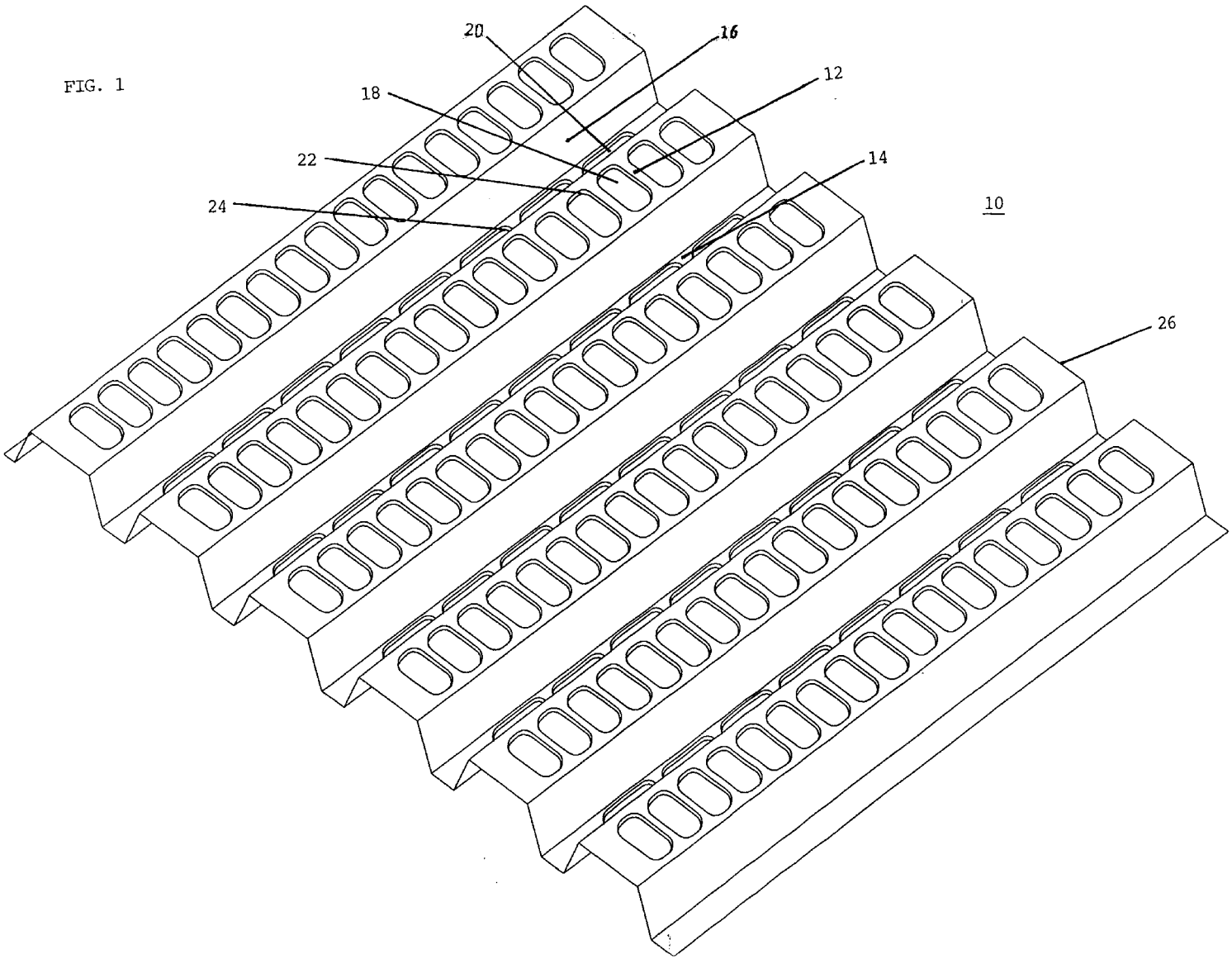
FIG. 1 is a perspective view of a section of a corrugated deck of the present invention.
Figure 2:
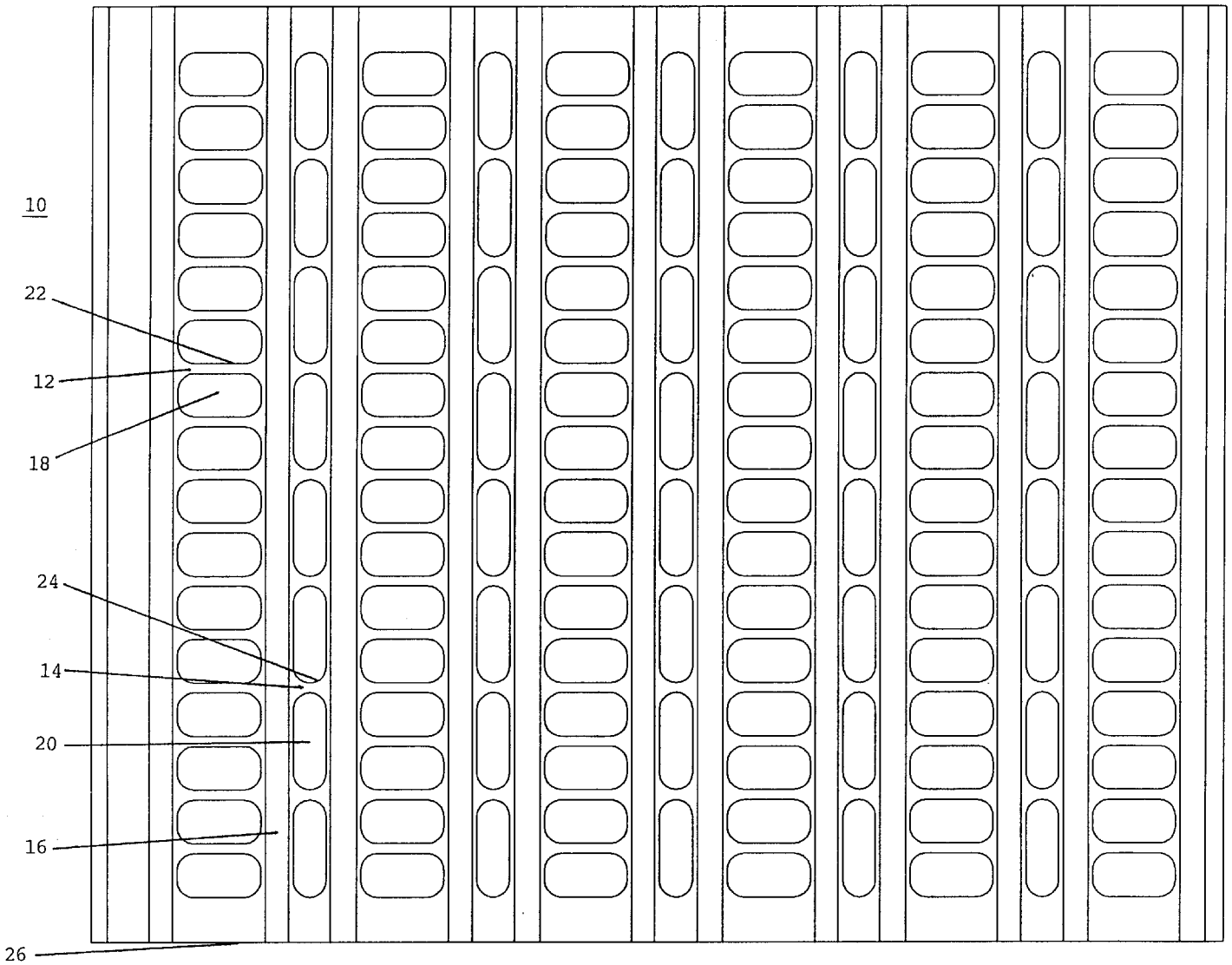
FIG. 2 is a top plan view of the same section of a corrugated deck of the present invention.
Figure 3:
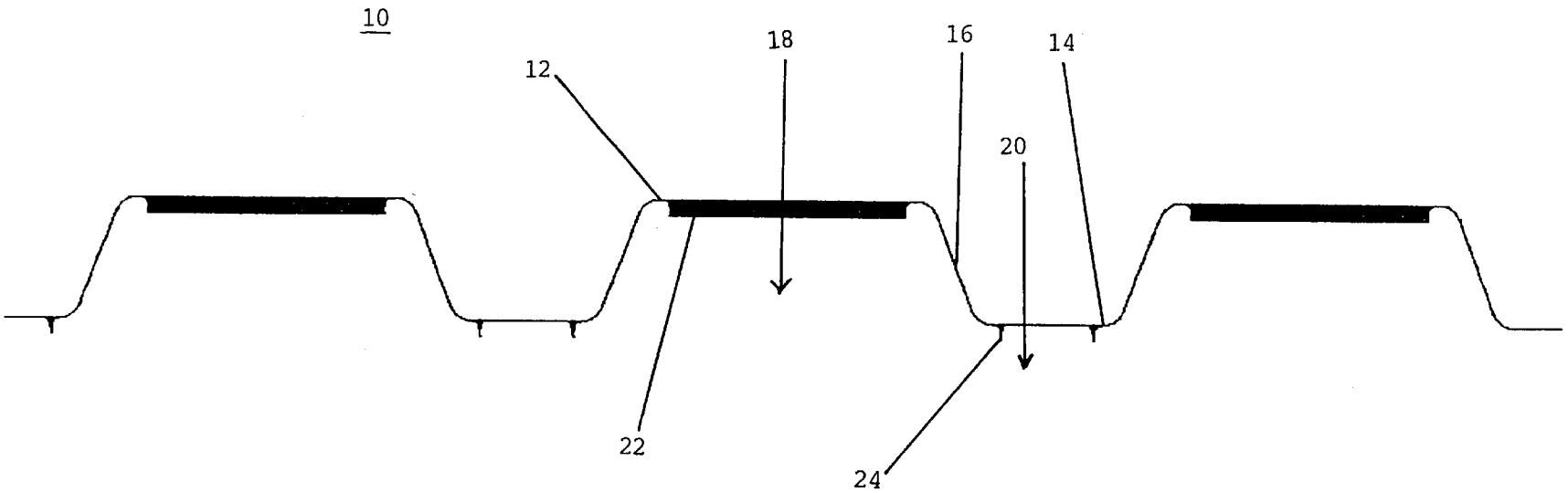
FIG. 3 is a cutaway, cross-sectional view of a strip of corrugated deck.

FIGS. 1, 2 and 3 illustrate the essential features of a corrugated deck of the present invention. As seen in FIGS. 1 and 2, a corrugated deck 10 will have top horizontal surface areas 12, bottom horizontal surface areas 14, and vertical surface areas 16. Punched or formed into the top and bottom horizontal surface areas 12 and 14, respectively, are a plurality of apertures 18 and 20. Surrounding the apertures 18 and 20 are vertical flanges 22 and 24, respectively. Also seen in FIGS. 1 and 2 is a portion of a terminal edge 26 of the corrugated deck.

In FIG. 3, a strip of the corrugated deck shown in FIGS. 1 and 2 has been cut away to show the cross-sectional geometry of the vertical flanges 22 and 24 surrounding the apertures 18 and 20. As one can see, the material of the top horizontal surface area 12 surrounding the aperture 18 slopes downward, forming a vertical flange 22. The material of the bottom horizontal surface area 14 surrounding the aperture 20 likewise slopes downward, forming a vertical flange 24.

In the preferred embodiment of FIGS. 1 and 2, the deck is manufactured from sheets of galvanized steel commonly used for roofs. The apertures 18 and 20 are punched into the metal and the surrounding metal is drawn downward to form the vertical flanges 22 and 24. The process of punching metal is well known to those skilled in the art of metal fabrication.

The manufacture of corrugated decks of the present invention involves the following process. First, the metal sheets are rollformed into decks and cut to length to a tight tolerance. After the sheets have been formed into decks and cut to length, they are sent through the punching operation. This operation consists of feeding the sheets through a punch press that is equipped with specialized tooling. The punch press first punches the holes into the flat surface of the sheets, and then draws the metal surrounding the holes downward to form the vertical flanges, as indicated above.

The punch press works by indexing the sheets. The press will make a first set of holes in a sheet and then index the sheet forward. The press will then make another set of holes in the same sheet and at the same time draw the metal surrounding the holes that were made in the previous operation cycle into vertical flanges. The press finishes a deck by making the last set of flanges and pushing the sheet out to be stacked for shipping. This operation can be run with different degrees of automation depending on demand for the product.

Figure 4:
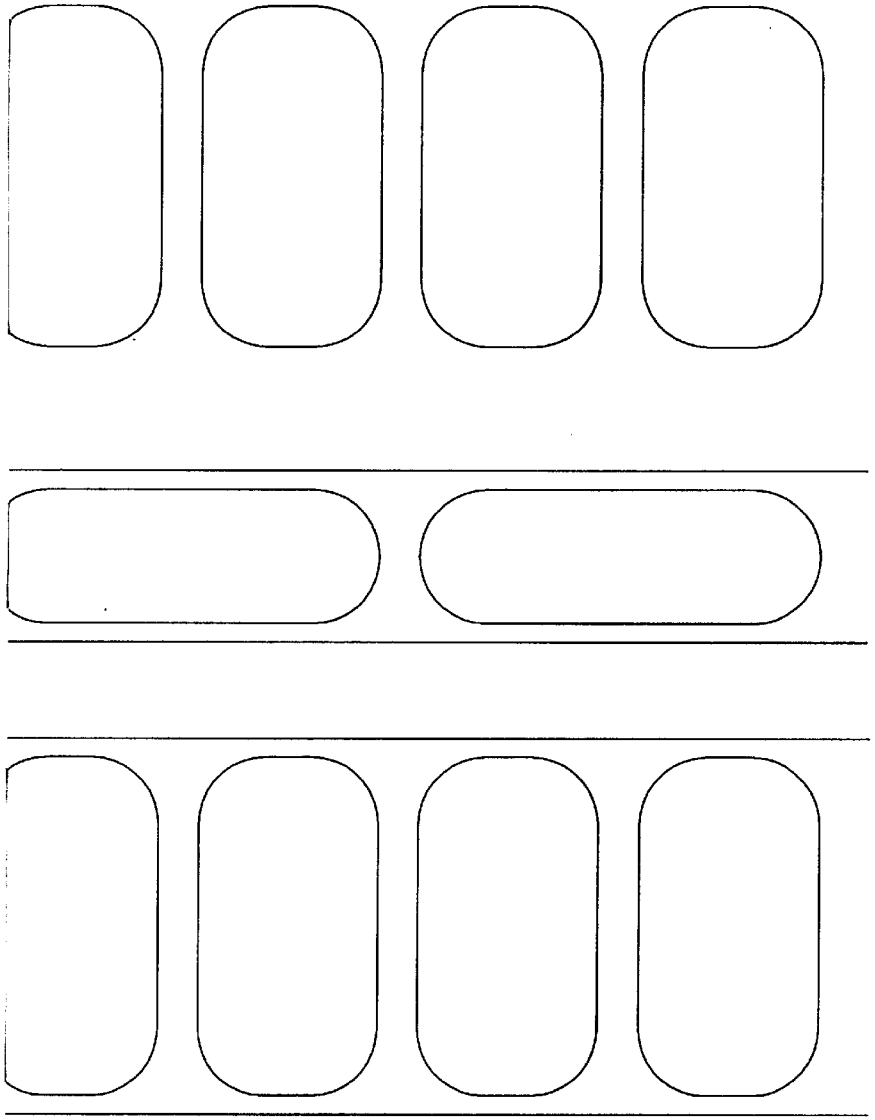
FIG. 4 is a pattern used to create the corrugated deck shown in FIGS. 1 and 2.

FIG. 4 shows the pattern used to create the corrugated deck shown in FIGS. 1 and 2. The size and shape of the apertures, and their frequency on the top and bottom horizontal surface areas, may vary depending upon the percentage of open area required by the applicable fire code, and the specific requirements of the user (e.g., amount of load-bearing capacity). For example, if the deck needs to have only twenty-percent open area, then the top and bottom horizontal surface areas could have fewer apertures per row, or smaller apertures per row. Accordingly, the number of predetermined patterns created for corrugated decks of this invention are practically limitless, constrained only by fire code and user requirements and/or preferences.

Figure 5:
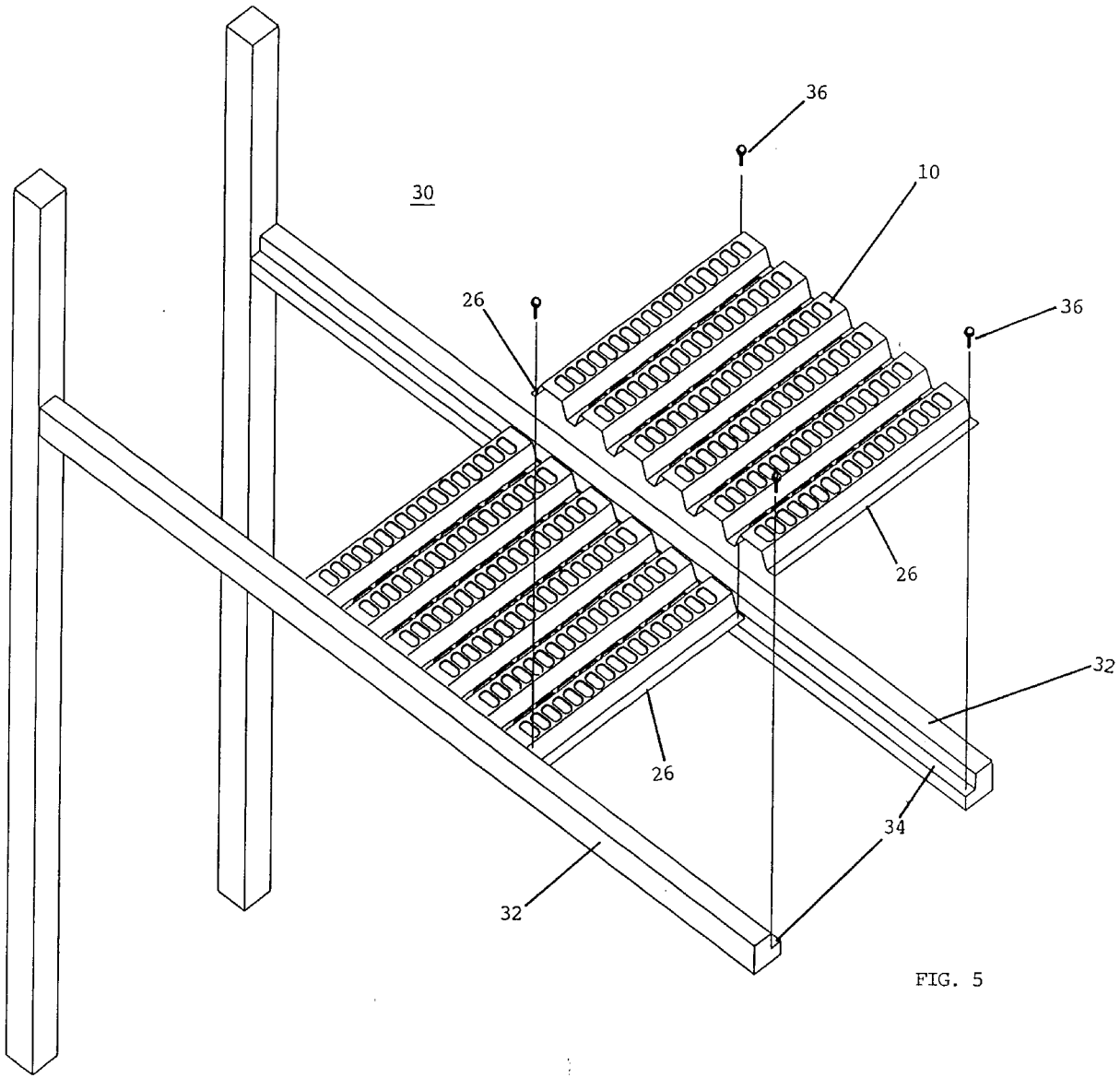
FIG. 5 is a environmental view of a corrugated deck of the present invention, as used in a storage rack.

FIG. 5 depicts a corrugated deck 10 of the present invention as part of a storage rack 30. Each deck 10 is inserted between two L-shaped support beams 32. It rests on the ledges 34 of the support beams. The decks are fastened to the support beams with bolts 36. Note that a terminal edge 26 of one deck overlaps with a terminal edge 26 of an adjacent deck when the decks are properly positioned on and fastened to the support beams 32.

Although the preferred embodiments of this invention are corrugated decks made of sheet steel, other materials such as plastic and fiberglass would also be suitable. For example, if the deck is made from a durable plastic, the apertures 18 and 20 and the vertical flanges 22 and 24 could be formed by extruding the plastic into a mold or cast of the predetermined pattern.

The cross-sectional geometry of the vertical flanges 22 and 24 depicted in FIG. 3 will vary with routine experimentation. The preferred embodiment shown in FIGS. 1 and 2 were modeled with a computer to ensure that the resulting structures would pass standard tests for stress and deflection. The preferred embodiment and other designs have undergone tests (1) to determine the amount and distribution of stress and the degree of deflection in typical load-bearing situations, and (2) to calculate the rate of flow of liquid through the apertures. The first set of tests have confirmed the validity of the designs from the standpoint of achieving uniform load-bearing capacity. The second set of tests have demonstrated that the rate of flow of water through the apertures greatly exceeds the maximum rate of water discharge by sprinkler systems used in industrial and commercial settings.

The corrugated decks of this invention have been shown to be less costly to manufacture than wire mesh decks. They are more durable than wire mesh.

Although this invention has been described in the above specification and illustrated in the referenced drawings in connection with certain preferred embodiments, it is to be understood that modifications and variations may be made to it without departing from the spirit of the invention, as those skilled in this art will readily understand. Such modifications and variations are considered to be within the purview and scope of this invention as defined by the claims below.

We claim:

1. A corrugated deck for use as shelving in a storage rack, the deck having a plurality of top horizontal surface areas, bottom horizontal surface areas, and vertical surface areas; the top and bottom horizontal surface areas having a plurality of apertures, the size, shape and frequency of which are specified by a predetermined pattern, and downwardly sloping, vertical flanges formed therefrom surrounding each aperture.

2. The corrugated deck of claim 1, wherein the deck is made from galvanized steel.

3. The corrugated deck of claim 1, wherein the deck is made from fiberglass.

4. The corrugated deck of claim 1, wherein the deck is made from plastic.

5. The corrugated deck of claim 1, wherein the top and bottom horizontal surface areas have apertures occupying fifty percent of their total surface area.

6. A storage rack having as shelving the corrugated deck of claim 1.

7. A storage rack having as shelving the corrugated deck of claim 2.

8. A storage rack having as shelving the corrugated deck of claim 3.

9. A storage rack having as shelving the corrugated deck of claim 4.

10. A storage rack having as shelving the corrugated deck of claim 5.

11. A storage rack having as shelving the corrugated deck of claim 6.

12. The corrugated deck of claim 1, wherein the size, shape and frequency of the apertures in the top horizontal surface area are specified by a first predetermined pattern, and the size, shape and frequency of the apertures in the bottom horizontal surface areas are specified by a second predetermined pattern.

13. The corrugated deck of claim 12, wherein the first predetermined pattern is different from the second predetermined pattern.

14. The corrugated deck of claim 13, wherein the first predetermined pattern is a pattern of first oblong apertures, a longitudinal axis of each of the first oblong apertures being parallel to a longitudinal axis of others of the first oblong apertures and perpendicular to a longitudinal direction of the bottom horizontal surface area.

15. The corrugated deck of claim 14, wherein the second predetermined pattern is a pattern of second oblong apertures, a longitudinal axis of each of the second oblong apertures being parallel to a longitudinal axis of others of the second oblong apertures and parallel to the longitudinal direction of the bottom horizontal surface area.

16. The corrugated deck of claim 15, further comprising edge regions located at periphery edges of the corrugated deck, the periphery edges being located at opposite ends of the longitudinal direction of the bottom horizontal surface areas, the edge regions having no apertures in the bottom horizontal surface areas.

17. The corrugated deck of claim 16, wherein the edge regions extend along the longitudinal direction of the bottom horizontal surface areas a first distance, the first distance being at least as long as a bearing surface of a support structure used to support the corrugated deck.

18. The corrugated deck of claim 1, further comprising edge regions located at periphery edges of the corrugated deck, the periphery edges being located at opposite ends of a longitudinal direction of the bottom horizontal surface areas, the edge regions having no apertures in the bottom horizontal surface areas.

19. The corrugated deck of claim 18, wherein the edge regions extend along the longitudinal direction of the bottom horizontal surface areas a first distance, the first distance being at least as long as a bearing surface of a support structure used to support the corrugated deck.

20. The corrugated deck of claim 5, wherein the size, shape and frequency of the apertures in the top horizontal surface area are specified by a first predetermined pattern, and the size, shape and frequency of the apertures in the bottom horizontal surface areas are specified by a second predetermined pattern.

21. The corrugated deck of claim 20, wherein the first predetermined pattern is different from the second predetermined pattern.

22. The corrugated deck of claim 21, wherein the first predetermined pattern is a pattern of first oblong apertures, a longitudinal axis of each of the first oblong apertures being parallel to a longitudinal axis of others of the first oblong apertures and perpendicular to a longitudinal direction of the bottom horizontal surface area.

23. The corrugated deck of claim 22, wherein the second predetermined pattern is a pattern of second oblong apertures, a longitudinal axis of each of the second oblong apertures being parallel to a longitudinal axis of others of the second oblong apertures and parallel to the longitudinal direction of the bottom horizontal surface area.

24. The corrugated deck of claim 23, further comprising edge regions located at periphery edges of the corrugated deck, the periphery edges being located at opposite ends of the longitudinal direction of the bottom horizontal surface areas, the edge regions having no apertures in the bottom horizontal surface areas.

25. The corrugated deck of claim 24, wherein the edge regions extend along the longitudinal direction of the bottom horizontal surface areas a first distance, the first distance being at least as long as a bearing surface of a support structure used to support the corrugated deck.

26. The corrugated deck of claim 5, further comprising edge regions located at periphery edges of the corrugated deck, the periphery edges being located at opposite ends of a longitudinal direction of the bottom horizontal surface areas, the edge regions having no apertures in the bottom horizontal surface areas.

27. The corrugated deck of claim 26, wherein the edge regions extend along the longitudinal direction of the bottom horizontal surface areas a first distance, the first distance being at least as long as a bearing surface of a support structure used to support the corrugated deck.

* * * * *